US006897395B2

(12) United States Patent
Shiibashi et al.

(10) Patent No.: US 6,897,395 B2
(45) Date of Patent: May 24, 2005

(54) MAIL SORTER

(75) Inventors: Ryosuke Shiibashi, Osaka (JP); Toshio Kanbe, Osaka (JP); Masakazu Shimomura, Osaka (JP); Shigeru Yoshikawa, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 85 days.

(21) Appl. No.: 10/438,570

(22) Filed: May 15, 2003

(65) Prior Publication Data

US 2003/0226789 A1 Dec. 11, 2003

(30) Foreign Application Priority Data

Jun. 10, 2002 (JP) ..... 2002-168720

(51) Int. Cl.[7] ..... B07C 5/00

(52) U.S. Cl. ..... 209/584; 209/657; 209/707; 209/900

(58) Field of Search ..... 209/583, 584, 209/651, 655, 657, 698, 707, 900; 198/359, 360, 370.03, 370.05; 271/298, 300

(56) References Cited

U.S. PATENT DOCUMENTS 2,580,229 A * 12/1951 Kendall ..... 198/360
3,148,783 A * 9/1964 Sidney ..... 198/349.9
3,782,541 A * 1/1974 Wood ..... 209/584
4,804,078 A * 2/1989 Scata' ..... 198/346.2
5,419,457 A * 5/1995 Ross et al. ..... 209/616
5,718,321 A * 2/1998 Brugger et al. ..... 198/359
6,276,509 B1 * 8/2001 Schuster et al. ..... 198/370.02
6,501,041 B1 * 12/2002 Burns et al. ..... 209/584
6,561,339 B1 * 5/2003 Olson et al. ..... 198/349
2003/0209473 A1 * 11/2003 Brinkley et al. ..... 209/547

FOREIGN PATENT DOCUMENTS

DE 63-8824 2/1988
DE 4202244 A1 * 7/1993 ..... B65G/47/46

* cited by examiner

*Primary Examiner*—Donald P. Walsh
*Assistant Examiner*—Joseph Rodriguez
(74) *Attorney, Agent, or Firm*—Dann, Dorfman, Herrell and Skillman; Henry H. Skillman

(57) ABSTRACT

A mail sorter, which can reliably sort mail while avoiding the breakage and the recovery mistake of mail released from conveyor baskets, which move on the mail sorting line in circulation. The mail sorter has a conveyor line with a conveying forward run and a conveying return run closely arranged back to back with each, and layered mail recovery box groups are disposed along a lower region of the conveying return run in parallel to each other. The mail recovery box groups comprise lowest stage boxes for recovering mail M released from conveyor baskets on the conveying forward run through a transverse deflection chute, middle stage boxes for recovering mail M released from the conveyor baskets on the conveying forward run through a discharge chute, and uppermost stage boxes for recovering mail M released from the conveying baskets on the conveying return run through a buffer chute.

2 Claims, 6 Drawing Sheets

MAIL SORTER

FIELD OF THE INVENTION

The present invention relates to a mail sorter, which sorts mail conveyed by a plurality of conveyor baskets, which are circulated along a mail sorting line, past every receiver which sorts the mail for a group of mail recovery boxes.

BACKGROUND OF THE INVENTION

As disclosed in, for example Japanese examined patent publication No. Sho. 63-8824, in a conventional mail sorter, mail recovery boxes are arranged in a series along the lower region of a mail sorting line in which a number of conveyor baskets circulate. Each recovery box is associated with a sorting operator or a sorting receiver which selects the recovery box to receive the mail from the conveyor basket. The conveyor baskets circulate past every sorting receiver in the series. The respective mail pieces are released from the conveyor baskets and are recovered in the mail recovery boxes selected by the receiver. It is noted that the term "mail" in the present invention means a sheet-shaped piece of mail in which a flat object such as a magazine or the like was sealed.

Further, with the disclosed form of the mail recovery boxes, a simple one stage system is adopted along the mail sorting line taking the form of the mail recovery boxes into consideration so that a sorting operator can smoothly perform sorting recovery operation, maintenance operation and the like, and so that the mail released from the conveyor baskets in a state of circular movement can be reliably recovered into the mail recovery boxes through sufficient receiving spaces.

However, since such a conventional mail sorter adopts one-stage system as a form of mail recovery boxes, when a number of sorting receivers are required, mail recovery boxes are arranged around the substantially entire periphery of the mail sorting line or the mail sorting line itself is elongated.

When the former is used, an operation area for the operator must be ensured to some extent around the substantially entire periphery of the mail sorting line and there occurs a problem that the mail sorting line cannot be provided near a side wall of the building, that is a restriction on the design of the line. On the other hand, when the latter is used, the space for providing the mail sorting line becomes limited.

Alternatively, when the conventional mail sorting line comprising a number of circulating conveyor baskets, and mail recovery boxes arranged along the lower region of the conveyor baskets may be provided in upper and lower two stages, the space limitation in a viewpoint of floor space of the building due to the elongation of the line itself can be removed. However, since an operating position where the operator is liable to operate easily is occupied as an conveyor space for the conveyor baskets on the mail sorting line provided on the lower side, the setting height of the mail recovery box is restricted in its space and the workability is also remarkably limited.

Alternatively, when the above-mentioned problems are intended to be solved by layering only the mail recovery boxes in multi-stages along a mail sorting line, the mail sorting line on which a number of conveyor baskets are moved in circulation, is provided at a higher position of the building and the mail recovery boxes must be layered in multi-stages in the lower region. Accordingly, there were problems that a great drop is generated between the conveyor baskets and the mail recovery boxes on the lowest stage whereby mail may be damaged and the likelihood of a recovery error is also created. In addition to the operational problems, there was a problem that the maintenance operations for the circulating conveyor baskets could be impaired.

SUMMARY OF THE INVENTION

Accordingly, the objects of the present invention are to solve the problems of the above-described conventional prior art technology, and to provide a mail sorter, which can reliably sort mail while avoiding the damage and the recovery errors of mail released from the conveyor baskets, which circulate in the mail sorting line, and which has simple maintenance, a very high degree of freedom in layout of the mail sorting line and very high efficiency use of floor space.

The above-mentioned problems are solved by a mail sorter, which recovers the respective mail conveyed by a number of conveyor baskets, which circulate in a mail sorting line, to mail recovery box groups for every sorting receiver, characterized in that the sorting line is a loop having a conveying forward run and a conveying return run which are closely arranged back to back with each other. The mail recovery box groups are disposed along a lower region of said conveying return run parallel to each other, and said mail recovery box groups comprise multiple layers, in the lowest stage boxes for recovering mail released from the conveyor baskets on said conveying forward run, the mail is directed through a driven deflection chute, in the middle stage boxes for recovering mail released from the conveyor baskets on said conveying forward run, the mail is directed through a discharge chute, and in the uppermost stage boxes for recovering mail released from the conveying baskets on said conveying return run is directed through a buffer chute.

Further, the above-mentioned problems are solved by that, in addition to the multi-layered arrangement, a belt conveyor for carrying mail into said middle stage boxes is continuously disposed at the lower end of said discharge chute.

Since the present invention has the above-mentioned configurations, a number of mail pieces are moved on the mail sorting line in circulation while being conveyed by conveyor baskets and is sorted and recovered into mail recovery box groups according to the respective sorting receivers.

First, a conveying forward run and a conveying return runage in said mail sorting line are closely arranged back to back with each other, said mail recovery box groups are disposed along a lower region of said conveying return run parallel to each other, and mail released from the conveyor baskets on the conveying forward run is recovered into the lowest stage boxes for a mail recovery box group through a transverse deflection chute in accordance with the respective sorting receivers or is recovered into the middle stage boxes through a discharge chute.

On the other hand, mail released from the conveyor baskets on the conveying return run is recovered into the uppermost stage boxes through a buffer chute. As described above, even if the mail, which moves on the mail sorting line in circulation, is released from any one of the conveying forward run and conveying return run in accordance with the mail sorting receivers, the mail is recovered into the mail recovery box groups disposed on one side of the mail sorting line that is a lower region of the conveying return run parallel to each other while sliding the respective types of chutes corresponding to the respective mail sorting receivers.

Further, in addition to recovering mail into the layered recovery box groups, a carrying-in belt conveyor for carrying mail in said middle stage boxes is continuously disposed on the downstream side of said discharge chute. Thus, the mail discharged from the discharge chute is reliably transferred from the conveying forward run side to the conveying return run side by the carrying-in belt conveyor to carry the mail into the middle stage boxes.

DESCRIPTION OF A PREFERRED EMBODIMENT OF THE INVENTION

Figure 1:
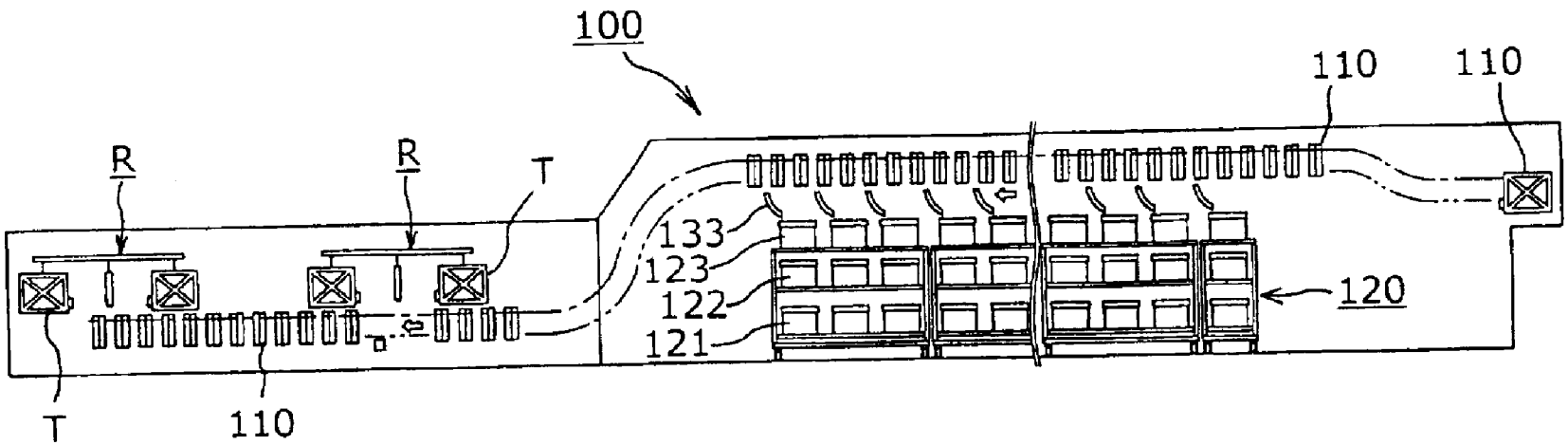
FIG. 1 is a front view showing the entire outline of a mail sorter according to one example of the present invention.
Figure 2:
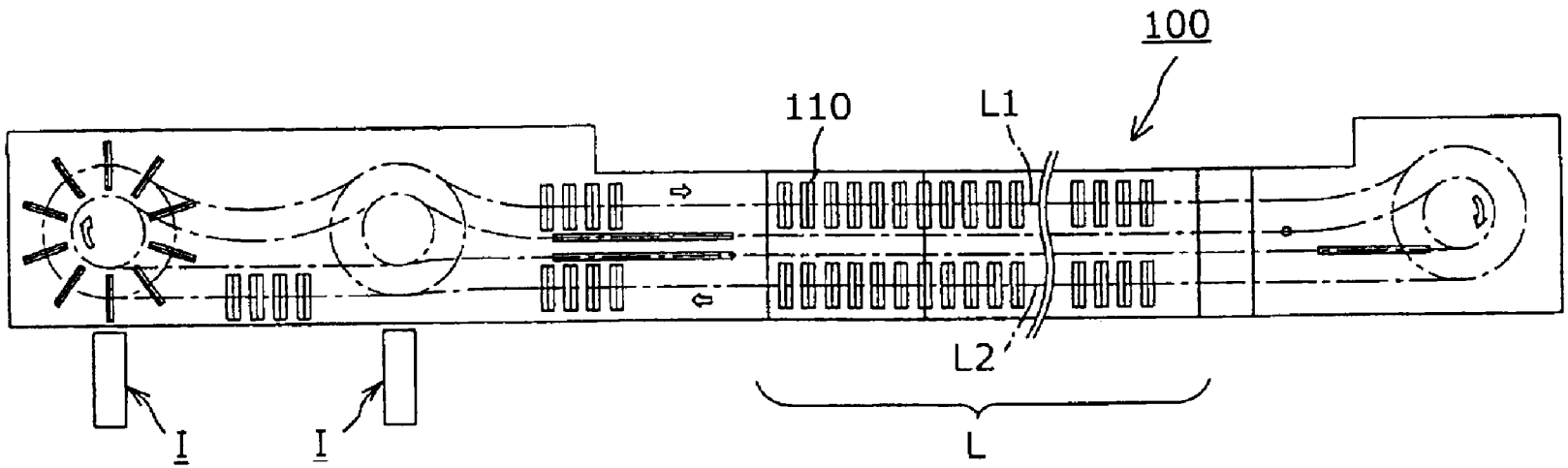
FIG. 2 is a plan view of the mail sorter shown in FIG. 1.

First, a mail sorter 100 according to the present invention shown in FIGS. 1 and 2 recovers the respective mail M (see FIG. 3) conveyed by a number of conveyor baskets, which move on a mail sorting line L in circulation in a forward run L1 and a return run L2 past a series of sorting receivers (not shown). Each receiver directs mail M into one of a plurality of layered mail recovery box groups 120. The reference characters I in FIG. 2 denote mail charging devices including a sorting receiver data reader for charging non-sorted mail M to the mail sorter 100 of the present invention, the reference characters R in FIG. 1 denote a mail sorting and distributing transfer system for receiving non-sorted mail M from the mail charging device I by use of transfer baskets and transferring the mail to the mail sorter 100 of the example according to the present invention, and the arrow in FIG. 2 denotes a direction of movement of the conveyor basket 110, which moves on the mail sorting line L in circulation.

Further, as shown in FIG. 2, a conveying forward run L1 and a conveying return run in the mail sorting line L are closely arranged back to back so that a linear sorting zone is formed and the above-mentioned mail recovery box groups 120 are disposed along a lower region of the conveying return run L2 parallel to each other.

Now, a sorting mechanism, which is the most characteristic in the mail sorter 100 of the example, will be described with reference to FIG. 3.

The above-mentioned mail recovery box groups 120 are layered and comprise the lowest stage boxes 121 for recovering mail M released from the conveyor baskets 110 on the conveying forward run L1 through a transverse deflection chute 131, the middle stage boxes 122 for recovering mail M released from the conveyor baskets 110 on the conveying forward run L1 through a discharge chute 132, and the uppermost stage boxes 123 for recovering mail M released from the conveying baskets 110 on said conveying return run L2 through a buffer chute 133.

Figure 3:
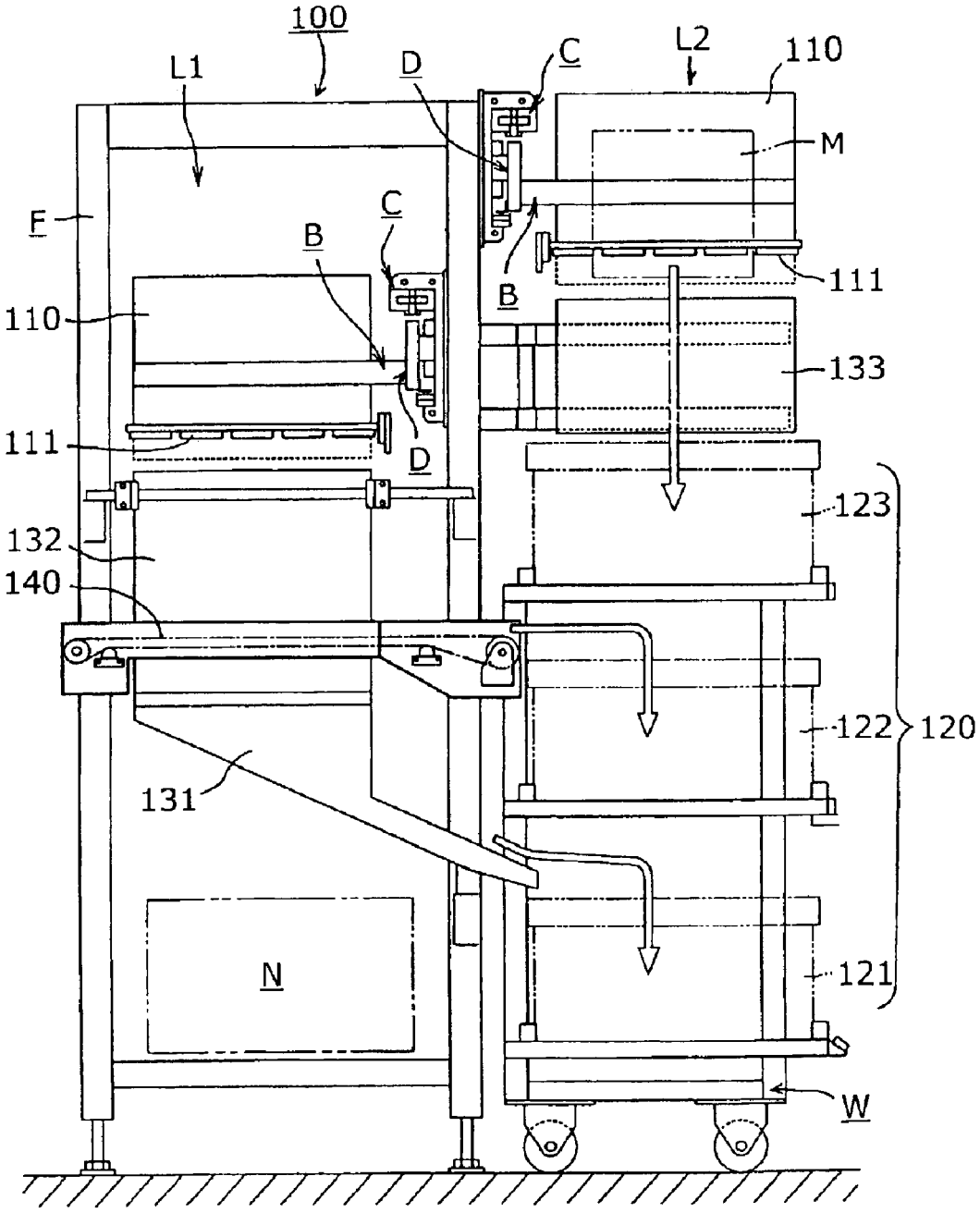
FIG. 3 is a transverse view of conveyor baskets and the layered mail recovery box groups in the mail sorter of FIG. 1.
Figure 4:
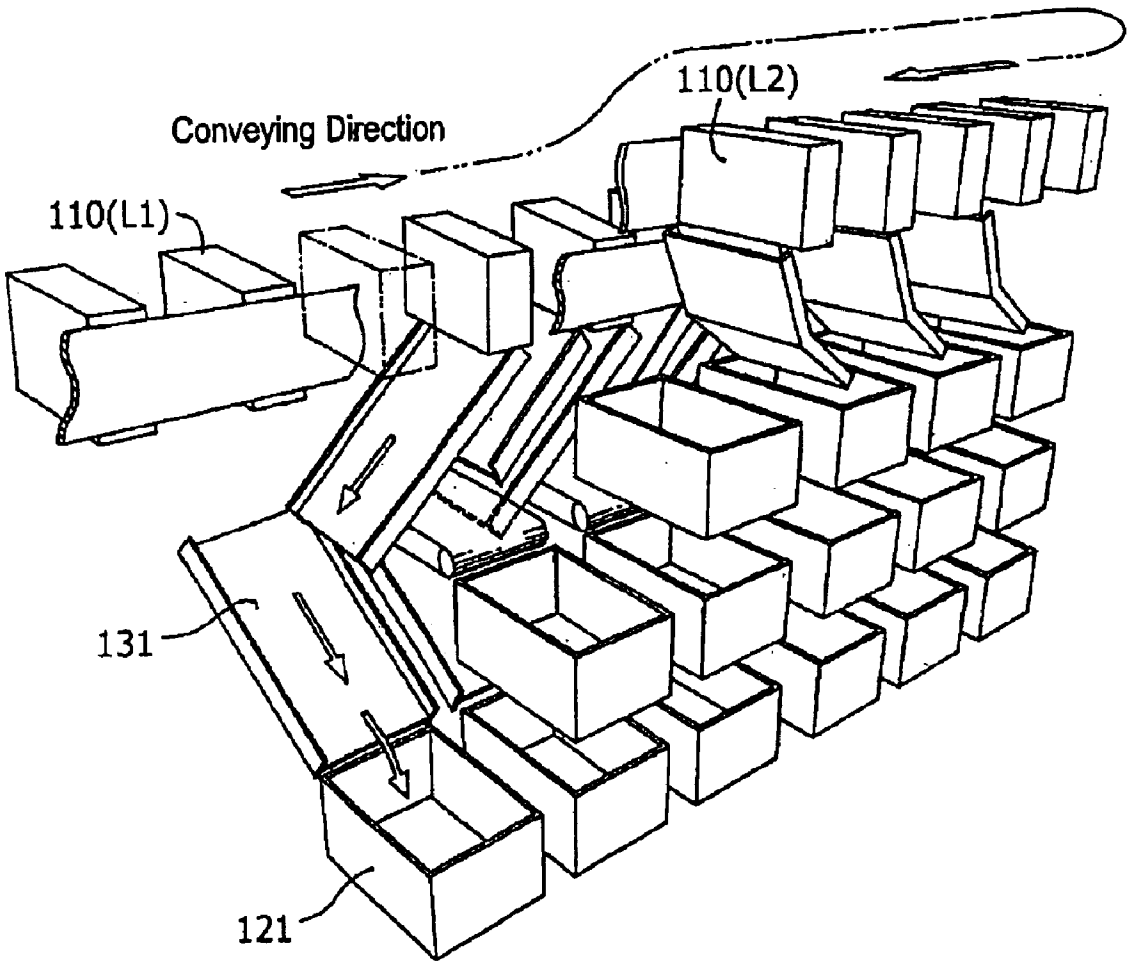
FIG. 4 is a perspective schematic view showing the path of mail pieces into the lowest stage recovery boxes.
Figure 5:
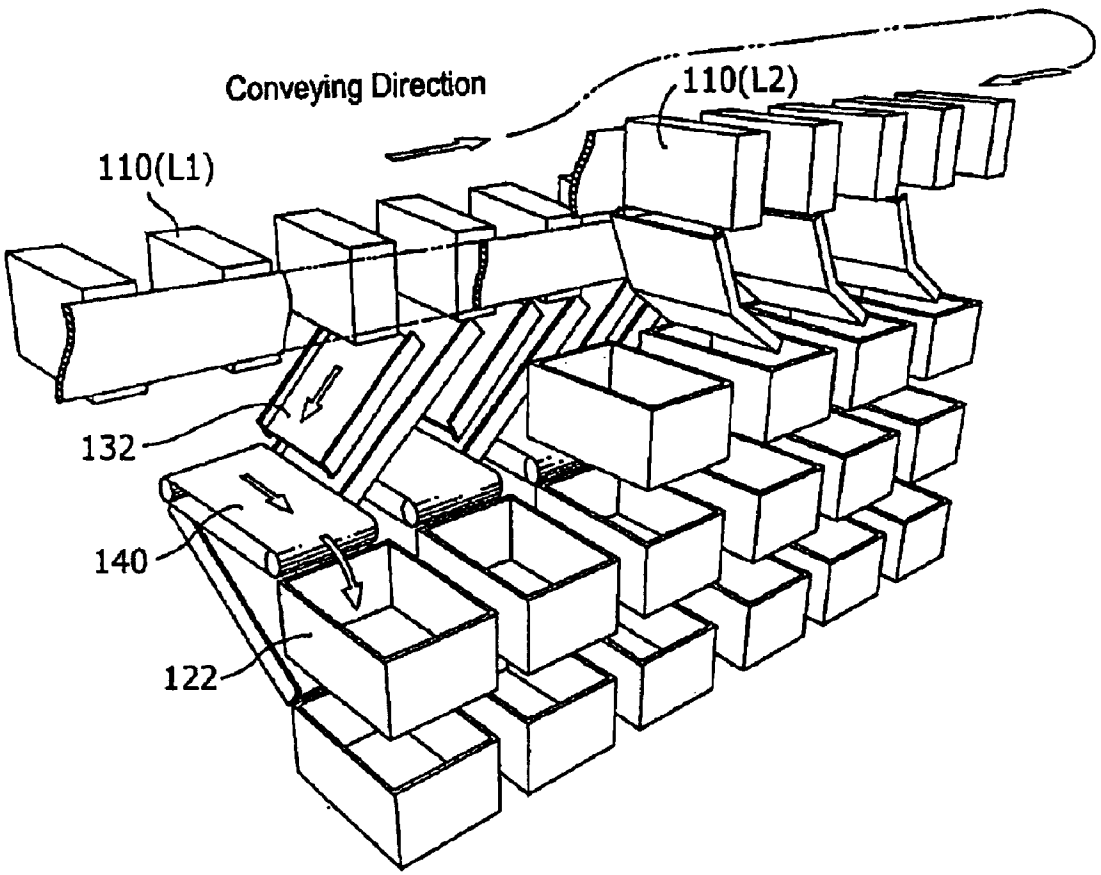
FIG. 5 is a perspective schematic view showing the path of mail pieces into the middle stage recovery boxes.
Figure 6:
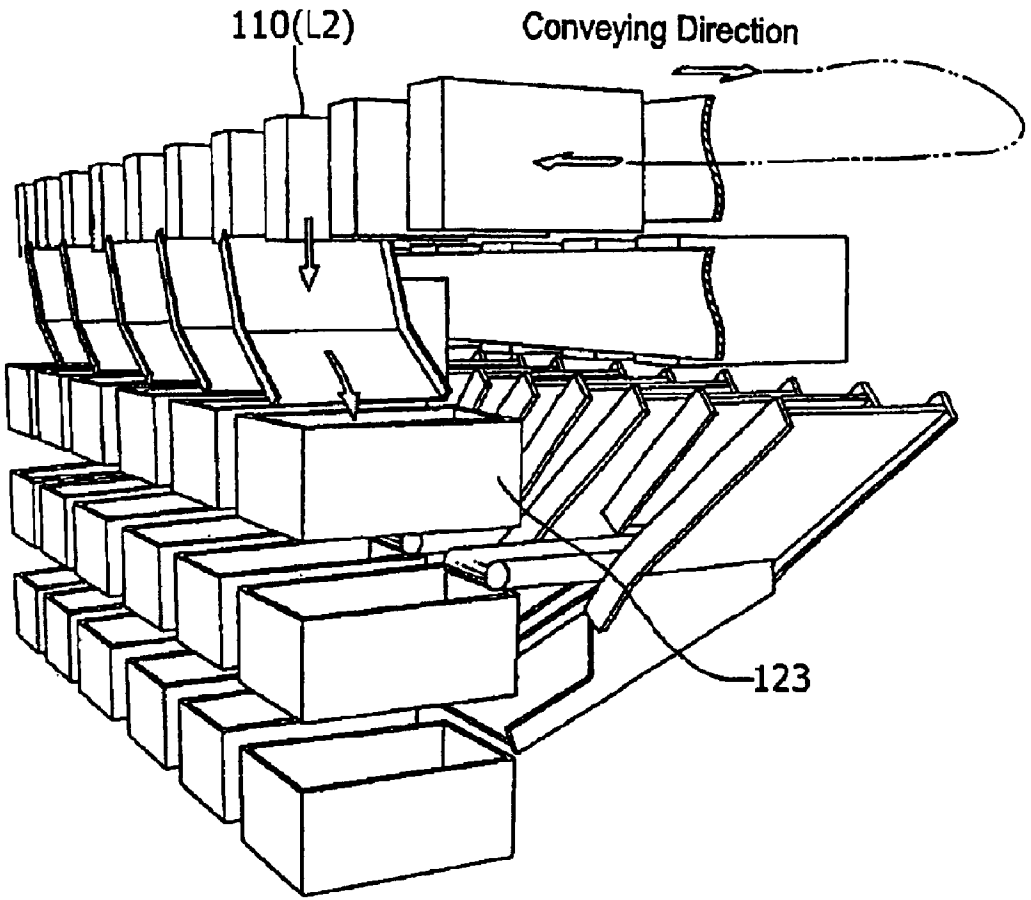
FIG. 6 is a perspective schematic view showing the path of mail pieces into the uppermost stage recovery boxes.

Further, an opening/closing plate 111 provided at the bottom of the conveyor basket 110 is openably formed by an opening/closing mechanism including a locking pin, a release lever and the like, which are not shown in FIG. 3. When this opening/closing plate 111 has been opened, mail M is released from the conveyor basket 110 to be discharged.

Here, the reference character F in FIG. 3 denotes a frame of the mail sorting line L, the reference character C denotes a connecting chain for transmitting power by connecting a number of baskets 110, the reference character B denotes a support bracket for connecting the conveyor baskets 110 to the connecting chain C at regular intervals, the reference character D denotes the conveyor which includes a driving linear motor for movably driving the conveyor baskets 110 in a horizontal direction or in a vertical direction, and the reference character W denotes a conveyor truck, which can be accessibly moved to the mail sorting line L while mounting the lowest stage boxes 121, the middle stage boxes 122 and the uppermost stage boxes 123, defining the layered mail recovery box groups 120.

Therefore, even if the mail M, which is moved on the mail sorting line L in circulation is released from any one of runs of the conveying forward run L1 and the conveying return run L2 as determined by the sorting receivers, the mail M can be recovered into any one of the mail recovery box groups 120 disposed on one side of the mail sorting line L or below the conveying return run L2 in parallel to each other while sliding on various chutes 131, 132 and 133 as determined by the sorting receivers.

Additionally, a carrying-in belt conveyor 140 for carrying mail in the middle stage boxes 122 is continuously provided on the downstream side of the discharge chute 132, and the carrying-in belt conveyor 140 reliably transfers mail M discharged from the discharge chute 132 from the conveying forward run L1 side to the conveying return run L2 side so that the mail M can be carried into the middle stage boxes 122.

It is noted that in the case of the mail sorted, as shown in FIG. 3, the layout of the conveying forward run L1, which moves mail M in circulation, is at least at a higher position than the position of the middle stage box 122. Accordingly, the lower region of the conveying forward run L1 can significantly have a vacant space along the longitudinal direction of the line, whereby a sorting controller N or other sorting receiver can be disposed, thereby maximizing use of the vacant space. As a result, further space efficiency can be ensured.

The mail sorter 100 of the present example obtained as described above, freely selects the transverse deflection chute 131, the discharge chute 132 and the buffer chute 133 in accordance with the recovery positions of the mail to be sorted, and at the same time the mail recovery box groups 120 are formed in a three-stage layered structure consisting of the lowest stage boxes 121, the middle stage boxes 122 and the uppermost stage boxes 123. Thus, the mail sorter 100 of the present example can avoid breakage due to rapid drop of mail and can reliably sort the mail M into the lowest stage boxes 121, the middle stage boxes 122 and the uppermost stage boxes 123 as determined by the respective sorting receivers for the mail recovery box groups 120 through the transverse deflection chute 131, the discharge chute 132 and the buffer chute 133 whereby the recovery mistakes are not generated.

Further, even if mail M, which is moved on the mail sorting line L in circulation, is released from any one of runs of the conveying forward run L1 and the conveying return run L2, closely disposed back to back to each other in accordance with the sorting receivers of these mail M, the sorter 100 is formed so that the mail M is recovered into the mail recovery box groups 120 disposed on one side of the mail sorting line L or below the conveying return run L2 in parallel to each other while sliding on various chutes 131, 132 and 133 as determined by the sorting receivers. Accordingly, the maintenance of the mail sorting line L can be easily performed concentratedly from one side and since the mail sorting line L can be arranged even in a space near a side wall of the building, a degree of freedom of layout and setting space efficiency of the mail sorting line L can be remarkably improved with substantial good effects.

As described above, according to the mail sorter of the present invention, a conveying forward run and a conveying return run in said mail sorting line are closely arranged back to back with each other and said mail recovery box groups are disposed along a lower region of said conveying return run parallel to each other, and said mail recovery box groups comprise the lowest stage boxes for recovering mail released from the conveyor baskets on said conveying forward run through a transverse deflection chute, the middle stage boxes for recovering mail released from the conveyor baskets on said conveying forward run through a discharge chute, and the uppermost stage boxes for recovering mail released from the conveying baskets on said conveying return run through a buffer chute. Therefore, the following advantages are obtained by the present invention.

The mail sorter freely selects the transverse deflection chute, the discharge chute and the buffer chute in accordance with the recovery positions of the mail to be sorted, and at the same time the mail recovery box groups are formed in a layered structure consisting of the lowest stage boxes, the middle stage boxes and the uppermost stage boxes. Thus, the mail sorter of the present example can avoid breakage due to rapid drop of mail and can reliably sort the mail into the lowest stage boxes, the middle stage boxes and the uppermost stage boxes selected by the respective sorting receivers for the mail recovery box groups through the transverse deflection chute, the discharge chute and the buffer chute.

Further, even if mail, which is moved on the mail sorting line in circulation, is released from any one of runs of the conveying forward run and the conveying return run, closely disposed back to back to each other as determined by the sorting receivers of these mail pieces, the sorter is formed so that the mail is recovered into the mail recovery box groups disposed on one side of the mail sorting line or below the conveying return run in parallel to each other while sliding down various chutes, selected by the sorting receivers. Accordingly, the maintenance of the mail sorting line L can be easily performed primarily from one side and since the mail sorting line L can be arranged even in a space near a side wall of the building, a degree of freedom of layout and space efficiency of the mail sorting line L can be remarkably improved.

Further, in addition to the advantages discussed above, a carrying-in belt conveyor for carrying mail in said middle stage boxes is continuously disposed on the downstream side of said discharge chute. Thus, the mail discharged from the discharge chute is reliably transferred from the conveying forward run side to the conveying return run side by the carrying-in belt conveyor to carry the mail in the middle stage boxes, whereby the mail can be reliably sorted by the middle stage boxes.

What is claimed is:

1. A mail sorter, which recovers the respective mail conveyed by a number of conveyor baskets, which moves the mail on a mail sorting line in circulation, into mail recovery box groups, characterized in that:

said sorting line comprises a conveying forward run and a conveying return run closely arranged back to back with each other, said mail recovery box groups are disposed in lowest stage, middle stage and uppermost stage layers along a lower region of said conveying return run in parallel to each other, each layer having a chute associated with it, and said mail recovery box groups comprise the lowest stage boxes for recovering mail released from the conveyor baskets on said conveying forward run through a transverse deflection chute, the middle stage boxes for recovering mail released from the conveyor baskets on said conveying forward run through a discharge chute, and the uppermost stage boxes for recovering mail released from the conveying baskets on said conveying return run through a buffer chute.

2. The mail sorter according to claim 1, including a carrying-in belt conveyor disposed on the downstream side of said discharge chute for continuously carrying mail into said middle stage boxes.

* * * * *